United States Patent [19]

Carey et al.

[11] 4,440,082

[45] Apr. 3, 1984

[54] ELECTROSTATICALLY ASSISTED PRINTING SYSTEM

[75] Inventors: Richard D. Carey; Bruce E. Berlin, both of Waynesville, N.C.

[73] Assignee: Dayco Corporation, Dayton, Ohio

[21] Appl. No.: 960,141

[22] Filed: Nov. 13, 1978

[51] Int. Cl.[3] ..... B41F 9/00; B41F 13/18

[52] U.S. Cl. ..... 101/170; 101/153

[58] Field of Search ..... 101/153, 170, 152, 151, 101/219, 228, 426, DIG. 13; 427/13, 14, 25, 32; 355/38, 3 TE, 10; 118/647, 648, 651, 638

[56] References Cited

U.S. PATENT DOCUMENTS

| | | | |
|---|---|---|---|
| 2,483,462 | 10/1949 | Huebner | 101/426 |
| 2,558,900 | 7/1951 | Hooper | 101/219 |
| 2,590,321 | 3/1952 | Huebner | 101/114 |
| 2,654,315 | 10/1953 | Huebner | 101/426 X |
| 2,667,121 | 1/1954 | Huebner | 101/219 |
| 2,676,100 | 4/1954 | Huebner | 101/426 X |
| 2,901,374 | 8/1959 | Gundlach | 101/DIG. 13 |
| 3,328,193 | 6/1967 | Oliphant et al. | 101/426 X |
| 3,661,081 | 5/1972 | Wright | 101/219 X |

FOREIGN PATENT DOCUMENTS

| | | | |
|---|---|---|---|
| 605012 | 7/1948 | United Kingdom | 101/153 |

*Primary Examiner*—J. Reed Fisher

*Attorney, Agent, or Firm*—Joseph V. Tassone

[57] ABSTRACT

A printing system having an electric circuit supplying an output potential to assist the transfer of ink to a printable substrate is provided wherein the potential is applied to the substrate 12 prior to entry of the substrate into the nip 14 of the printing apparatus.

5 Claims, 6 Drawing Figures

ELECTROSTATICALLY ASSISTED PRINTING SYSTEM

The present invention relates to an electric printing system and method and particularly to a system wherein an electric potential is applied to a moving dielectric substrate to assist in transfer of ink to the substrate.

The use of electric or electrostatic energy in the transfer of pigmented materials is well known, particularly as applied to spray painting. Its use is not unknown in printing, but until quite recently, it has not been successfully applied to commercial work such as publication, catalog and package printing. Most of the proposed electrostatic printing systems have undertaken to avoid the use of a printing impression, i.e., positive physical contact between the web and a printing cylinder or similar element carrying the pigment. Such systems have undertaken to attract the pigment to the web through a small air gap ionized by an electrostatic charge. Such systems do not lend themselves to the use of liquid inks or dyes, but require relatively light and finely divided dry pigment, having low cohesive and adhesive properties, so that they will flow readily and can be attracted to the web across the air gap. While some progress has been made along these lines, such methods have had little or no commercial impact in publication and package printing, primarily because of their experimental nature, questionable advantage over conventional printing and the highly special and rather costly and complex equipment required.

Recently, a system for electrostatically assisting the transfer of liquid ink in otherwise conventional rotogravure printing operations has been introduced. This system deliberately makes use of a printing impression or "nip" which induces some transfer of ink to the web as it is propelled between an impression cylinder and a conventional printing cylinder which carries the inked pattern to be applied to the web. This system can permit the use of lighter impression pressures than normally required in conventional printing, since the ink transfer is augmented and improved by the application of an electrostatic charge. This system contemplates utilization of existing high-speed, web-fed presses, without extensive or costly modification, and the use of conventional liquid inks and commonly used grades of paper, paperboard, plastic film, and laminates of such materials.

This system, as disclosed by U.S. Pat. No. 3,477,369, comprises a metal printing cylinder, a web of substantially non-conductive material, a metal impression cylinder having a resilient, conductive outer covering, an electrically conductive contact element in physical contact with the outer surface of the impression cylinder, and a source of relatively high voltage, low amperage direct current. The voltage source is connected and supplies regulated electrical energy to the outer covering of conductive, resilient material of the impression cylinder. This conductive outer covering is prevented from short-circuiting the current to the frame of the press or other conductive structure by a layer of dielectric material provided between the cylindrical metal shell or core of the impression cylinder and the outer covering. The metal printing cylinder is grounded (or connected to that terminal of the power supply of opposite polarity to that connected to the conductive outer covering of the impression cylinder), so that a difference in potential is established between the impression and printing cylinders through the web which is in contact with both cylinders. The resulting electrostatic charge applied to the ink, in the pattern thereof on the printing cylinder, attracts it to the web and materially improves its transfer.

In rotogravure printing, this electrostatically assisted system has been promoted on the basis that it accomplishes more complete emptying of the ink carrying cells to give better and more uniform ink distribution in the web. This eliminates or greatly reduced the phenomenon known as snowflaking or skipped dots in the printed copy, which is a rather common fault occurring when some of the cells give up little or no ink to the web. This fault is particularly prevalent in delicate or lightly shaded areas of the copy and also occurs in more heavily pigmented areas when employing either relatively rough surfaced as relatively rigid and unyielding printing stocks, such as, for example, paperboard and uncalendered or lightly calendered stock made from wood pulp (e.g., newsprint). The electrostatically assisted system permits the use of rougher and lower priced stocks than would otherwise be suitable for the quality of printing generally demanded in publication, catalog and packaging work.

Although it has been established that improved ink transfer results from using the above or similar systems, such systems suffer from the disadvantage that they may not conform to the safety standards applicable to rotary printing machines. Their principal drawback has been the danger that an electrical spark resulting from the high voltages employed could ignite the explosive vapors which are present in a gravure printing environment.

One solution to the problem of high voltage sparking is provided by U.S. Pat. No. 3,619,720 which discloses an electric circuit for generally increasing the applied potential in an electric printing system up to a breakdown potential value, the applied potential being set back a predetermined amount each time the breakdown potential is approached so that the applied potential essentially follows variations in the dielectric strength of the printing web during normal operation.

According to a relatively new process, an electrostatic field is induced onto the impression roller by an inductor electrode positioned close to the nip. The inductor electrode is positioned a discrete distance from the impression roller. Screening slides may be used to control the width of the electrostatic field. In the event that the web tears or has holes therein, the ink is attracted to the impression roller, thereby requiring shutdown for clean up.

It is therefore an object of the present invention to provide a novel method for printing employing electrostatic assist.

It is another object to provide a novel apparatus for printing using electrostatic assist.

Other objects, aspects and advantages of the present invention will be apparent to those skilled in the art from the following description, appended claims and attached drawing.

In accordance with the present invention there is provided a printing method which comprises inducing an electrostatic charge onto a moving web to be printed upon, prior to entry of the web into the nip of the printing apparatus.

Also in accordance with the present invention there is provided an electrostatically assisted rotogravure printing system comprising a rotogravure printing press comprising a printing cylinder, an impression cylinder, an ink supply, and means for moving a web of substrate to be printed upon through the press, and an electrostatic assist apparatus comprising a high voltage power supply, and means for inducing an electrostatic charge onto the web, which means is electrically connected to one terminal of the power supply, the other terminal being electrically connected to the printing cylinder and other parts of the printing press, and which means is positioned such that the electrostatic charge is induced onto the web immediately prior to entry of the web into the nip between the printing cylinder and the impression roller.

Figure 1:
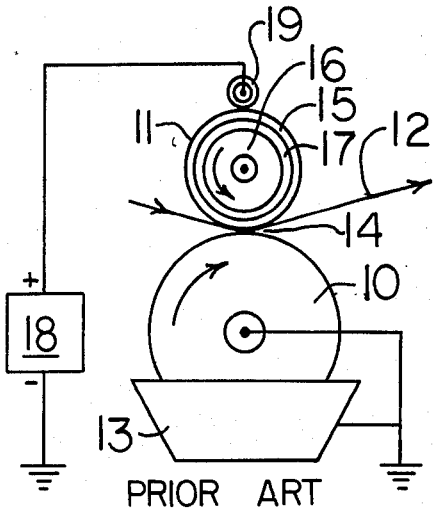
PRIOR ART FIG. 1
FIGS. 1 and 2 illustrate two prior art electrostatically assisted rotogravure printing systems.

In FIGS. 1–6, the substantially conventional members of the rotogravure printing units illustrated comprise a printing cylinder 10 and an impression cylinder 11, between and in contact with which the web 12 to be printed upon is propelled in the direction indicated by the arrows. The web 12 can be any printable substrate, such as, for example, paper or plastic. The printing cylinder 10, impression cylinder 11 and other members of the units are mounted in a suitable framework, not illustrated for the sake of simplicity. The printing cylinder 10 is driven through suitable driving means, not illustrated, and its lower portion is immersed in a pool 13 of ink. An intaglio pattern of the printing to be applied to the web 12 is normally etched into the gravure printing cylinder 10 and consists of closely-spaced minute depressions or cells which are substantially filled with ink as the printing cylinder 10 passes through the pool 13. Since the entire cylindrical surface of the gravure cylinder 10 is wetted with ink by immersion therein, the excess, i.e., that not contained in the intaglio pattern, is wiped from the cylinder by a wiper or "doctor" blade, not shown, before it reaches the impression or nip, indicated at 14, formed between the printing and impression cylinders.

In conventional practice, the entire printing press is mounted on a heavy foundation of reinforced concrete and the framework, cylinder shells, shafts, bearings, gearing, etc., are constructed of steel or other metals or alloys. Thus, the entire structure is electrically conductive and is at ground potential.

The impression cylinder 11 conventionally has an outer layer 15 of semi-conductive rubber or plastic, for example, rubber loaded with conductive carbon black. The layer 15 is insulated from the steel core 16 of the impression roller 11 by an intermediate cylindrical layer 17 of highly insulating material.

Conventionally, the impression cylinder 11 is mounted for movement toward and away from the printing cylinder 10 so that pressure can be exerted between the printing and impression cylinders in the nip area 14 when the impression is made.

The electrostatically assisted rotogravure printing units also comprise a high voltage power supply, designated generally by the reference numeral 18. A typical power supply provides DC voltage in the approximate range of 100 to 35,000 volts and a current in the approximate range of 0.1 to 3.0 milliamperes. In each of the illustrations, the printing cylinder 10, ink pool 13 and the negative side of the power supply 18 are shown as leading to ground potential. It is understood that the opposite polarity could be applied by properly insulating the appropriate members of the printing units from ground potential.

Referring now to FIG. 1, there is illustrated a conventional electrostatically assisted rotogravure printing unit. The high voltage of positive polarity is supplied to a conductive roller 19, which is constructed similar to the impression cylinder 11. The high voltage is distributed by the conductive roller 19 and transferred to the outer layer 15 of the impression cylinder 11, thus establishing a difference of potential across the nip 14.

Figure 2:
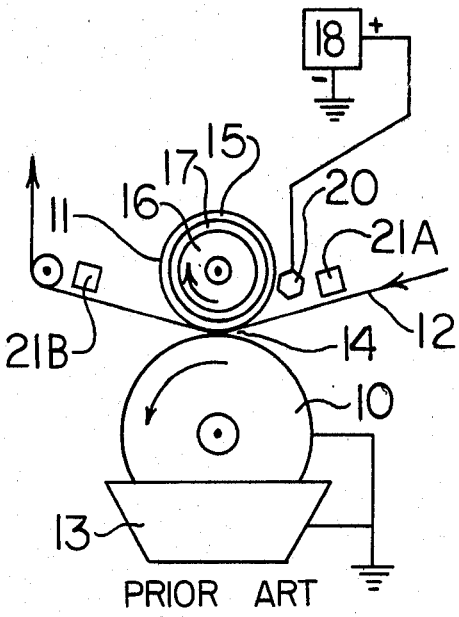
PRIOR ART FIG. 2

In another conventional electrostatically assisted rotogravure printing unit, shown in FIG. 2, the conductive roller is omitted, and instead, a charge is induced in the impression cylinder 11 by means of an inductor electrode 20. The inductor electrode 20 does not contact the impression cylinder 11, but is positioned a short distance, i.e., about 15 mm, away from the cylinder 11. As the web 12 enters the printing unit, it is neutralized by an ionizer bar 21*a* so that the web then carries no spurious electrostatic charge into the nip 14. The electrostatic charge induced in the cylinder 11 by the electrode 20 is carried in the semi-conductive layer 15 of the rotating cylinder 11 from the electrode 20 position around to the nip 14 position, where the electrons comprising the electrostatic charge flow to ground through the printing cylinder 10. The electrostatic charge presses the web 12 against the printing cylinder. As the web 12 leaves the printing unit, it is neutralized by an ionizer bar 21*b* so that the web carries no electrostatic charge out of the unit.

Figure 3:
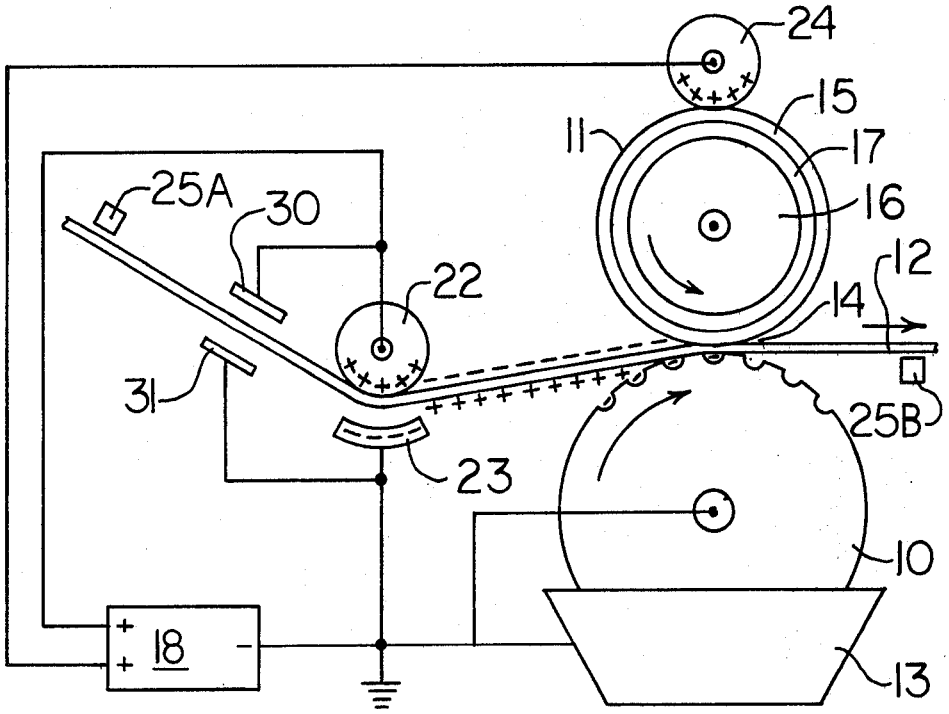
FIG. 3 is a schematic representation of one embodiment of a printing system in accordance with the present invention.

In accordance with the present invention, and as shown in FIGS. 3–6, an electrostatic charge is induced into the moving web 12 rather than into the impression cylinder 11 as was done in the prior art. Referring now to FIG. 3, the printing apparatus of the present invention comprises a printing cylinder 10, an impression cylinder 11, an ink pool 13 and means for inducing an electrostatic charge into a web 12 which comprise a power supply 18, an electrostatic charge roller 22, an electrostatic charge plate 23 and an optional conductive roller 24. The electrostatic charge roller 22 is electrically connected to the high voltage terminal of the power supply 18. The electrostatic charge plate 23 is electrically connected to the common terminal of power supply 18, which in the embodiment illustrated is also connected to the printing cylinder 10, the ink pool 13 and to ground potential. Optionally, the conductive roller 24 is electrically connected to a source of low voltage of the same polarity as the high voltage connected to the charge roller 22, the conductive roller 24 being shown as connected to the low voltage terminal of power supply 18. The web 12 may also be neutralized prior to inducing an electrostatic charge thereon by passing the web 12 in contact or nearly in contact with an ionizer 25*a*; the web should also be neutralized as it leaves the printing unit by an ionizer 25*b*.

During operation of the printing apparatus, a high voltage, generally about 100 to about 50,000 volts of direct current at about 0.1 to about 3.0 milliamperes, is impressed between the charge roller 22 and the charge plate 23. Optionally, a low voltage, ranging from about 1 to about 10 percent of the high voltage potential may be impressed between the conductive roller 24 and ground potential. As the web 12 passes between the charge roller 22 and charge plate 23, a potential is created on opposite surfaces of the web such that the surface which will contact the printing cylinder 10 is positively charged with respect to the opposite surface. When this surface approaches the printing cylinder 10, which carries ink of negative polarity, the ink is attracted away from the cylinder 10 and onto the surface of the web 12. Because of the low positive potential impressed upon the impression cylinder 11 through the conductive roller 24, a net buildup of negative charges on the impression cylinder 11 is prevented.

Figure 4:
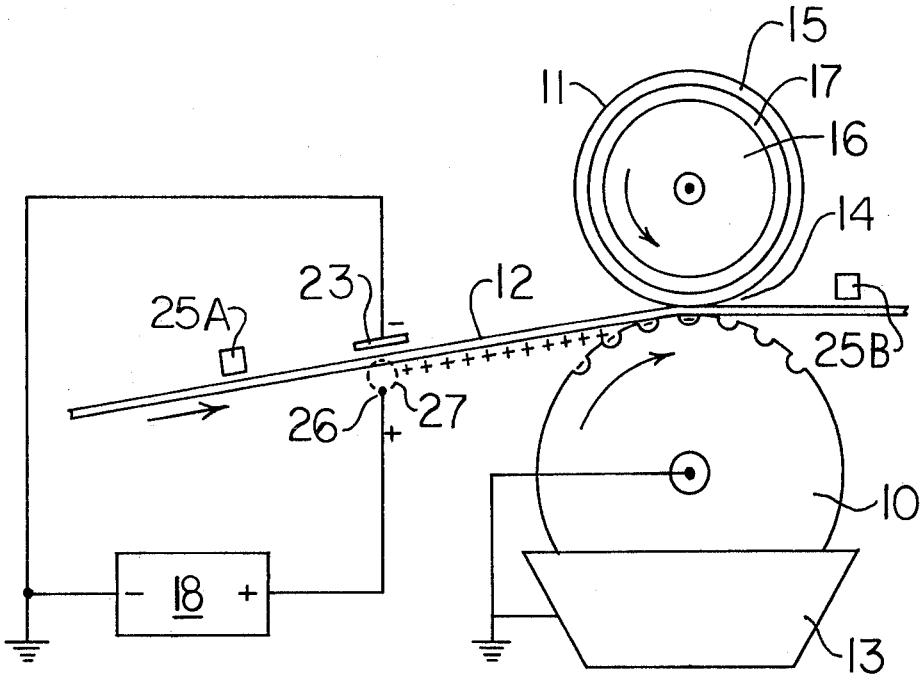
FIG. 4 illustrates another embodiment of the printing system of the present invention.

FIG. 4 illustrates another embodiment of the invention, wherein an electrostatic charge is induced in the web 12 by space charge, i.e., corona discharge, application. In this embodiment, high voltage of positive polarity is supplied to a thin wire electrode 26. The wire electrode 26 can be a thin wire stretched laterally across the web 12 and near to the surface thereof. Opposite the electrode 26 is a charge plate 23, which may be flat, as shown in FIG. 4, or curved, as shown in FIG. 3. The corona developed in the vicinity of the wire 26 is indicated at 27.

Figure 5:
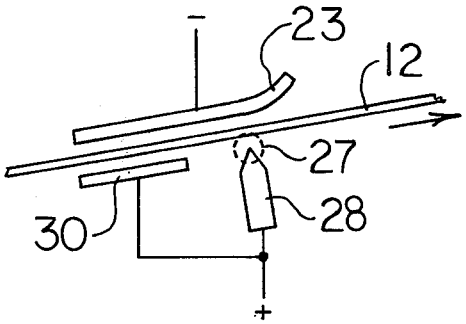
FIGS. 5 and 6 illustrate electrodes which may be used with the present invention.
Figure 6:
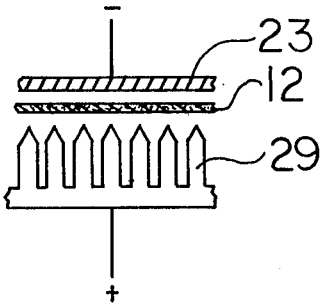

The space charge electrode may, alternatively, be a knife edge electrode 28, as shown in FIG. 5, or a plurality of needle electrodes 29, as shown in FIG. 6.

The electrode sets 22/23, 26/23, 28/23 or 29/23 are located on either side of the web 12 and as near to the nip 14 as possible without touching the printing cylinder 10 or the impression cylinder 11, yet, far enough away that there is no possibility or arcing between either electrode and the cylinders 10 and 11. Because of differences in sizes of printing presses, this distance will have to be determined in practice. In general, a distance of 5 to 10 centimeters, or greater, from the nip should be sufficient. If the electrodes are too close to the cylinders, there is danger of arcing; if the electrodes are too far from the nip the web may tend to wrap around the printing cylinder, thus leading to or promoting registration problems.

It may also be desirable to employ a pre-charging plate or plates arranged on one or both sides of the web 12 to assist in inducing the electrostatic charge onto the web. Referring again to FIG. 3, pre-charging plates 30 and 31 are located on either side of the web 12 ahead of the electrode set 22/23. The plate 30 is connected electrically to the charge roller 22 and the plate 31 is connected electrically to the charge plate 23. The plate 31 may also be incorporated with the charge plate 23 by extending the charge plate 23, as shown in FIG. 5.

As mentioned previously, the high voltage impressed across the electrodes can range from about 100 to about 50,000 volts d.c. The exact voltage must be determined in practice due to differences in the web material, web thickness, ink formulations and other factors.

Among the many advantages of the present invention is that the danger of arcing is virtually eliminated. Thus, a higher voltage may be used thereby providing greater electrostatic assist. This, in turn, allows higher operating speeds.

Another advantage is that the conductivity of the surface layer of the impression cylinder is not nearly as critical as was necessary in previous printing systems.

Reasonable variations and modifications, which will be apparent to those skilled in the art, can be made in this invention without departing from the spirit and scope thereof.

We claim:

1. In a process for printing upon a web of printable substrate wherein said web is passed between a printing cylinder and an impression roller and a high voltage electrostatic field is produced between said printing cylinder and said impression roller to assist the transfer of ink from said printing cylinder to said web, the improvement consisting of producing said high voltage electrostatic field only between said web and said printing cylinder prior to the entry of said web into the nip between said printing cylinder and said impression roller, thereby inducing said high voltage electrostatic charge only onto said web, and impressing a low voltage between said impression roller and said printing cylinder, said low voltage ranging from about 1 to about 10 percent of said high voltage electrostatic field, thereby preventing a net buildup of spurious charges on said impression roller.

2. The process of claim 1 wherein said electrostatic field ranges from about 100 to about 50,000 volts at a current in the approximate range of 0.1 to 3.0 milliamperes.

3. The process of claim 1 wherein said web is neutralized prior to inducing said charge thereon.

4. The process of claim 1 wherein said web is passed between pre-charging electrodes prior to inducing said charge thereon.

5. The process of claim 1 wherein said charge is induced by direct contact between said web and a charging electrode.

* * * * *